United States Patent [19]

Lau et al.

[11] Patent Number: 4,914,005

[45] Date of Patent: Apr. 3, 1990

[54] PHOTOGRAPHIC ELEMENT CONTAINING A CYAN DYE FORMING COUPLER

[75] Inventors: Philip T. S. Lau; Ping W. Tang; Stanley W. Cowan, all of Rochester, N.Y.

[73] Assignee: Eastman Kodak Company, Rochester, N.Y.

[21] Appl. No.: 392,756

[22] Filed: Aug. 11, 1989

Related U.S. Application Data

[63] Continuation-in-part of Ser. No. 56,194, Jun. 1, 1987.

[51] Int. Cl.[4] ..... G03C 7/34; G03C 5/44

[52] U.S. Cl. ..... 430/377; 430/384; 430/385; 430/393; 430/545; 430/552; 430/553; 430/627

[58] Field of Search ..... 430/545, 377, 393, 627, 430/384, 385, 552, 553

[56] References Cited

U.S. PATENT DOCUMENTS

| | | | |
|---|---|---|---|
| 3,615,508 | 10/1971 | Stephen et al. | 96/60 |
| 3,926,436 | 12/1975 | Monbaliu et al. | 96/67 |
| 4,201,589 | 5/1980 | Sakaguchi et al. | 430/139 |
| 4,214,047 | 7/1980 | Chen | 430/448 |
| 4,247,627 | 1/1981 | Chen | 430/512 |
| 4,358,533 | 11/1982 | Tokitou et al. | 430/512 |
| 4,368,258 | 1/1983 | Fujiwhara et al. | 430/493 |
| 4,374,722 | 2/1983 | Ohbuyashi et al. | 430/383 |
| 4,518,680 | 5/1985 | Koboshi et al. | 430/393 |
| 4,518,687 | 5/1985 | Hirano et al. | 430/548 |
| 4,612,278 | 9/1986 | Lau et al. | 430/381 |

FOREIGN PATENT DOCUMENTS

| | | | |
|---|---|---|---|
| 3336582 | 4/1984 | Fed. Rep. of Germany . | |
| 1276521 | 10/1961 | France | 430/627 |
| 137332 | 10/1979 | Japan | 430/377 |
| 54-137332 | 10/1979 | Japan . | |
| 1516855 | 7/1978 | United Kingdom . | |

OTHER PUBLICATIONS

British Journal of Photography Annual 1984, pp. 195–196.

Research Disclosure, Jul. 1980, Item No. 19551–*Research Disclosure* Emsworth Studios, Inc., New York, New York.

Resarch Disclosure, Dec. 1978, Item No. 17643–*Research Disclosure* Emsworth Studios, Inc., New York, New York.

*Primary Examiner*—Paul R. Michl
*Assistant Examiner*—Lee C. Wright
*Attorney, Agent, or Firm*—Joshua G. Levitt

[57] ABSTRACT

The reduction of cyan image dye to a leuco compound in a color photographic element by ferrous ion contained in a bleach processing solution is inhibited by the presence in the element of a polymeric latex having recurring units that are derived from certain lower alkoxyacrylate monomers optionally copolymerized with recurring units derived from certain acrylic ionomers.

8 Claims, No Drawings

PHOTOGRAPHIC ELEMENT CONTAINING A CYAN DYE FORMING COUPLER

This application is a continuation-in-part of our U.S. patent application Ser. No. 056,194 filed June 1, 1987, pending.

FIELD OF THE INVENTION

This invention relates to color photography and more particularly to photographic elements and methods for producing color images employing a light-sensitive silver halide emulsion comprising cyan dye forming couplers in association with certain lower alkoxyalkyl acrylate polymer latices.

BACKGROUND OF THE INVENTION

In color photography a dye image is formed during a process which includes the development of an imagewise exposed light-sensitive material comprising at least one silver halide emulsion layer and a dye forming coupler, followed by bleaching and fixing. During development, a color developing agent, usually a p-phenylenediamine, is oxidized in a reaction with silver halide, producing free silver. Oxidized developing agent then reacts with the coupler to form a dye whose color is determined by the chromophoric structure of the dye contributed by the coupler. Then, in the subsequent silver removing cycle, the developed silver is reoxidized by a bleaching agent and further fixed with a silver halide solubilizing agent for removal during the final wash cycle. An optional stabilizing treatment may be included prior to drying the so processed material.

The bleaching of the developed silver and the fixing of the silver halide for final removal from the element can be performed either in sequential steps using separate bleach and fix solutions or in one step using a single solution wherein the bleaching and fixing agents are combined. The latter solution is commonly referred to as a bleach-fix solution. Although a variety of oxidizing agents are known for use as silver bleaching agents in such bleach and bleach-fix solutions, metal complex salts of an organic acid, such as an EDTA-iron complex salt, have become a common bleaching agent because of their low toxicity and environmental safety. The use of such complexes in color photographic bleach and bleach-fix processing solutions is taught in, for example, U.S. Pat. Nos. 3,615,508; 3,770,437; 3,870,520; 4,242,442 and related art.

The use of such ferric complex salts as color photographic bleaching agents does, however, have certain disadvantages. One such disadvantage is the lower density of image dye derived from naphtholic and certain phenolic couplers in color photographic materials treated after color development in a solution containing such an organic complex salt as the bleaching agent. Although a variety of secondary conditions may contribute to an objectionably low density of image dye in any processed photographic material, it is the conversion of cyan image dye derived from naphtholic and certain phenolic couplers to a leuco compound which is generally recognized as the basic cause of the problem. Attempts made to overcome this problem have included a variety of approaches, such as modifying the bleach solution and/or the photographic element, treating the photographic element in a separate bath subsequent to the bleach step, or restricting the use of cyan dye-forming couplers to selected limited classes of compounds.

For example, U.S. Pat. Nos. 3,706,561; 3,770,437; 4,033,771; 4,301,236; 4,469,781 and 4,563,405 describe approaches which involve changing the concentration or composition of the bleach or bleach-fix solutions. U.S. Pat. No. 4,366,233 proposes to reduce the total amount of silver contained in layers disposed below the cyan dye-forming layer of a color photographic element. U.S. Pat. Nos. 3,820,997 and 4,469,781 and U.K. Pat. No. 1,393,335 relate to the treatment of the bleached photographic material with a variety of chemicals contained in a separate processing bath. U.S. Pat. Nos. 4,518,680; 4,374,922; and 4,591,548 disclose preferred classes of cyan dye-forming couplers for overcoming the above cited problem. The '548 patent also points to the presence of ferrous ions in the bleach solution as the cause for the conversion of cyan image dye to a leuco compound.

The art also recognizes that color photographic silver halide materials can contain acrylate and/or acrylic acid polymer latices for a variety of purposes. See U.S. Pat. Nos. 3,926,436; 4,201,589; 4,214,047; 4,247,627; 4,358,533; 4,612,278; German OLS 3,336,582; and Research Disclosure Item 19551, July 1980.

Also known in the art are polymeric couplers which contain acrylate repeating units as described in U.S. Pat. No. 4,612,278.

However, none of the art identified in the preceding paragraphs recognizes any connection between the problem of leuco dye formation and the presence of certain polymers, nor does it suggest the use of such polymers in conjunction with cyan couplers susceptible to leuco dye formation.

SUMMARY OF THE INVENTION

We have found that leuco dye conversion of cyan image dye by ferrous ions formed during the bleaching of imagewise developed silver in color photographic materials can be inhibited in the presence of certain polymer latices.

In one aspect, our invention is directed to a photographic element comprising a light-sensitive silver halide emulsion, a cyan dye forming coupler and a separate polymer latex having recurring units derived from a lower alkoxyalkyl acrylate monomer having the formula (I):

$$CH_2{=}CH{-}\overset{\overset{\displaystyle O}{\|}}{C}{-}[O{-}(CH_2)_m]_n{-}OCH_3 \qquad (I)$$

wherein m=1 to 4, and n=1 to 10.

In another aspect, our invention is directed to a process of bleaching silver from a photographic element containing a cyan image dye, wherein bleaching is performed in the presence of a polymer latex comprising recurring units of the monomer of formula (I).

In yet another aspect, our invention is directed to photographic elements containing cyan dye images formed by a process that includes this bleaching process.

The polymers useful in this invention are separate from the coupler and are free of repeating units containing coupler moieties. Thus they differ from polymers of the type described in Lau et al. U.S. Pat. No. 4,612,278 in which the polymer and the coupler are the same compound.

In a particularly preferred aspect our invention relates to such materials and processes in which the polymer latex further contains recurring units of an isomer of formula (II):

$$CH_2{=}CH{-}\overset{\overset{\displaystyle O}{\|}}{C}{-}[O{-}(CH_2)_m]_{n'}{-}X \qquad \text{(II)}$$

wherein m=1 to 4;

n'=0 to 10;

X, when n'=0, represents —OH, and

X, when n'=1 to 10, represents $-CO_2H$, $-SO_3H$, $-O-PO(OH)_2$ or a metal salt of $CO_2H$, $SO_2H$ or $-O-PO(OH)_2$.

In the polymer latices used in this invention, monomer (I) can comprise from 5 to 100% by weight of the total polymer, and ionomer (II) can comprise from 0 to 20%, and preferably from 2 to 10%, by weight of the total polymer. In addition, one or more other ethylenically unsaturated comonomers can be present in the latex polymers employed in this invention. Such additional monomers are selected to modify such physical and chemical properties of the polymer as solubility, compatibility, stability and flexibility.

The latex polymer is incorporated in the photographic element in a location and an amount that will be effective to reduce, or inhibit leuco dye formation in coupler-derived cyan dye as a result of bleaching in the presence of ferrous ions. In a common color negative format this amount can be in the range of 0.05 to 5.0 grams per square meter. Preferably the latex polymer is in the same layer as the cyan dye forming coupler.

It is surprising that the polymeric latices containing unts of formula (I) are useful to inhibit leuco dye formation while polymers derived from closely analogous acrylates are ineffective for this purpose.

The advantageous effects of this invention are especially obtained when bleaching is in a process which generates ferrous ions, such as one in which the bleaching agent is a ferric complex of a polycarboxylic acid, e.g., an iron-ethylene diamine tetracetic acid complex. Preferred cyan couplers are represented by one of the structural formulae III and IV,

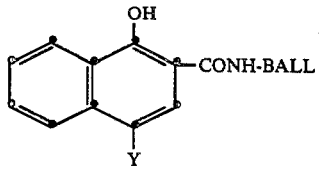

(III)

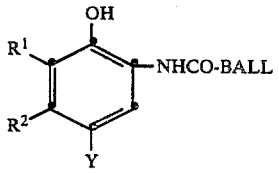

(IV)

wherein

BALL is a ballast group, $R^1$ is halogen, $R^2$ is hydrogen, lower alkyl or lower alkoxy, and Y is hydrogen or a coupling-off group.

Suitable couplers are described in U.S. Pat. Nos. 3,476,563 and 4,004,929.

Photographic elements of the invention can be single color elements or multicolor elements. Multicolor elements contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982.

In the following discussion of suitable materials for use in the emulsions and elements of this invention, reference will be made to *Research Disclosure,* December 1978, Item 17643, published by Industrial Opportunities Ltd., Homewell Havant, Hampshire, P09 1EF, U.K., the disclosures of which are incorporated herein by reference. This publication will be identified hereafter by the term "Research Disclosure".

The silver halide emulsions employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the cyan dye-forming couplers generally described above, the elements of the invention can include additional couplers as described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (See Research Disclosure Section VI), antistain agents and image dye stabilizers (see Research Disclosure Section VII, paragraphs I and J), light absorbing and scattering materials (see Research Disclosure Section VIII), hardeners (see Research Disclosure Section VI), plasticizers and lubricants (See Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents useful in the invention are p-phenylene diamines. Especially preferred are 4-amino-N,N-diethyl-aniline hydrochloride, 4-amino-3-methyl-N,N-diethylaniline hydrochloride, 4-amino-3-methyl-N-ethyl-N-β-(methanesulfonamido)-ethylaniline sulfate hydrate, 4-amino-3-methyl-N-ethyl-N-β-hydroxyethylaniline sulfate, 4-amino-3-β(methanesulfonamido)ethyl-N,N-diethylaniline hydrochloride and 4-amino-N-ethyl-N-(2-methoxyethyl)-m-toluidine di-p-toluenesulfonic acid.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the steps of bleaching, fixing, or bleach-fixing, as described above, washing and drying.

The polymer latices employed in this invention can be prepared by procedures known in the art and illustrated below. Typically this will be a free radical polymerization leading to an aqueous latex polymer. The resulting polymer typically is a high polymer having a molecular weight above about $1\times10^4$.

SYNTHESIS EXAMPLE 1

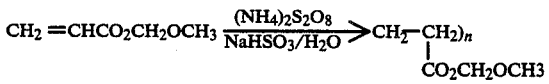

To a 500 ml 3-necked round bottom flask equipped with a mechanical stirrer, a nitrogen inlet tube and a reflux condenser, set in an 80° C. constant temperature bath, was added with stirring an aqueous solution of sodium dodecyl sulfate (50 ml, 0.1M), $N_2$-purged distilled water (50 ml), acrylate monomer (0.1 molar equiv.) and an aqueous solution of sodium bisulfite (6 ml, 0.5M). An aqueous solution of ammonium persulfate (15 ml, 0.2M) was added dropwise over a 10-minute period. After stirring for 2 hours, the mixture was cooled to room temperature and filtered. The clear latex was dialyzed for 3 days and then collected.

The invention is illustrated by the following examples. In these examples there was employed a common photographic film structure and composition, as shown below.

| PHOTOGRAPHIC FILM |
|---|
| Gelatin (1.08 g/m$^2$), Bis (vinylsulfonyl)ether hardener (0.09 g/m$^2$) Chemically sensitized AgBrI (6 mole % I) (1.6 g/m$^2$), Gelatin (2.4 g/m$^2$), Coupler as identified in the tables (1.61 mmole/m$^2$), LATEX as identified in the tables (0.41 g/m$^2$) |
| SUPPORT |

In the following examples each film segment was sensitometrically exposed through a graduated density test object for 3 seconds and then processed using the Kodak C-41 R process as described in the *British Journal of Photography* 1982 Annual, pp. 209–211.

After reading the red dye density (designated $D_i$) in each of the so processed elements of a step of the sensitometric curve closest to the density 1.0, each element was further treated for 5 minutes in a continuously-stirred, nitrogen-purged bath having the following composition:

| | |
|---|---|
| Distilled water | 800.0 ml |
| Ethylene diamine tetraacetic acid | 32.1 g |
| Concentrated ammonium hydroxide | 30.0 ml |
| Ferrous sulfate heptahydrate | 27.8 g |
| pH adjusted to 5.0 with $NH_4OH$ | |
| Total volume adjusted to 1 liter with water. | |

After subsequent washing for 5 minutes and final drying, each sample was reevaluated by another density reading (designated $D_f$) of the same step on the sensitometric curve. The percent dye loss as recorded in the following tables was calculated by dividing the initial density values ($D_i$) into the final density values ($D_f$).

EXAMPLE 1

In this example each element contained the coupler C-1, dispersed in half its weight of tricresyl phosphate. Elements 2, 3, 4, and 5 contained the homopolymer consisting of recurring units of the monomer.

Latex polymer containing units of:

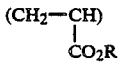

TABLE 1

| Element | R | % Dye Density Loss |
|---|---|---|
| 1 control | no polymer | 59 |
| 2 comparison | $(CH_2)_3CH_3$ | 81 |
| 3 comparison | $(CH_2)_2OH$ | 58 |
| 4 comparison | $(CH_2)_2OC_6H_5$ | 80 |
| 5 invention | $(CH_2)_2OCH_3$ | 10 |
| 6 invention | $(CH_2)_2O(CH_2)_2OCH_3$ | 1 |

The data in Table 1 show the superiority of the latex in Elements 5 and 6 in reducing cyan dye loss.

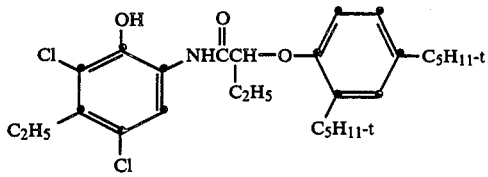

EXAMPLE 2

Each element in this example contained the cyan dye-forming coupler C-1, dispersed in half its weight of dibutylphthalate. Elements 7, 8, 9, 10, and 11 contained increasing amounts, as listed in Table 2, of the homopolymer employed in element 5.

TABLE 2

| Element | g solids/m$^2$ | % Dye Density Loss |
|---|---|---|
| 7 control | no polymer | 44 |
| 8 invention | 0.08 | 27 |
| 9 invention | 0.16 | 20 |
| 10 invention | 0.41 | 2 |
| 11 invention | 0.82 | 2 |
| 12 invention | 1.64 | 8 |

The data in Table 2 show the effectiveness of this polymeric latex even at low concentration.

EXAMPLE 3

Elements 13 to 16 contained the cyan dye-forming coupler C-2, incorporated in the silver halide emulsion without a coupler solvent. Elements 17 to 20 contained the cyan dye-forming coupler C-2, dispersed in half its weight of dibutylphthalate. Elements 14–16 and 18–20 contained the homopolymer consisting of recurring units of the monomer

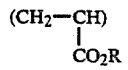

TABLE 3

| Element | R | % Dye Density Loss |
|---|---|---|
| 13 control | no polymer | 82 |
| 14 comparison | $(CH_2)_3CH_3$ | 92 |
| 15 invention | $(CH_2)_2OCH_3$ | 37 |
| 16 comparison | $(CH_2)_2OC_2H_5$ | 90 |
| 17 control | no polymer | 96 |
| 18 comparison | $(CH_2)_3CH_3$ | 96 |
| 19 invention | $(CH_2)_2OCH_3$ | 15 |
| 20 comparison | $(CH_2)_2OC_2H_5$ | 95 |

The data illustrate again the effectiveness of the compounds in elements 15 and 19 of the invention.

Cyan dye-forming coupler C-2 is

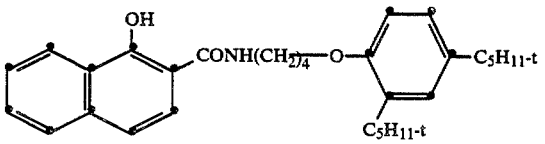

EXAMPLE 4

Elements 21 to 25 contained the coupler C-1 dispersed in half its weight of tricresyl phosphate. Elements 26 to 31 contained the coupler C-2 dispersed in half its weight of dibutylphthalate. Elements 22 to 25 and elements 27 to 31 contained the copolymer consisting of recurring units of the copolymerized monomers

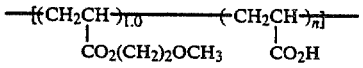

in which the proportion of acid was varied.

TABLE 4

| Element | % Acid | % Dye Density Loss |
|---|---|---|
| 21 control | no polymer | 46 |
| 22 | 1.4 | 7 |
| 23 | 3.1 | 7 |
| 24 | 6.7 | 7 |
| 25 | 10.4 | 3 |
| 26 control | no polymer | 92 |
| 27 | 1.4 | 74 |
| 28 | 2.0 | 56 |
| 29 | 3.1 | 50 |
| 30 | 6.7 | 38 |
| 31 | 10.4 | 13 |

The data show the improvement in dye stability attainable in the presence of copolymer latices of the invention.

The invention has been described in detail with particular reference to preferred embodiments thereof, but it will be understood that variations and modifications can be effected within the spirit and scope of the invention.

What is claimed is:

1. A photographic element comprising a radiation sensitive silver halide emulsion, a cyan dye forming coupler, and a latex polymer which is free of repeating units containing coupler moieties, the polymer comprising recurring units derived from a monomer represented by formula (I), below and up to 20% by weight of an ionomer represented by formula (II), below:

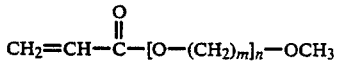

(I)

wherein m=1 to 4, and n=1 to 10;

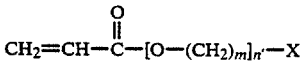

(II)

wherein m=1 to 4, n′=0 to 10,

X, when n′=0, represents —OH, and

X, when n′=1 to 10, represents $—CO_2H$, $—SO_3H$, $—O—PO(OH)_2$ or a metal salt of $—CO_2H$, $—SO_3H$, $—O—PO(OH)_2$.

2. A photographic element comprising a radiation sensitive silver halide emulsion, a cyan dye forming coupler, and a latex polymer which is free of repeating units containing coupler moieties, the polymer consisting essentially of recurring units derived from a monomer represented by formula (I), below, and up to 20% by weight of an ionomer represented by formula (II), below:

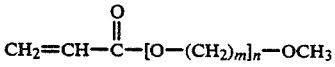

(I)

wherein m=1 to 4, and n=1 to 10;

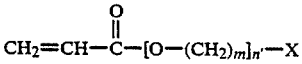

(II)

wherein m=1 to 4, n′=0 to 10,

X, when n′=0, represents —OH, and

X, when n′=1 to 10, represents $—CO_2H$, and $—SO_3H$, $—O—PO(OH)_2$ or a metal salt of $—CO_2H$, $—SO_3H$ or $—O—PO(OH)_2$.

3. A photographic element comprising:

a radiation sensitive silver halide emulsion;

a cyan dye forming coupler represented by one of structural formulae (III) and (IV):

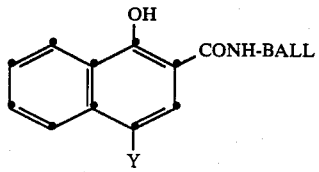

(III)

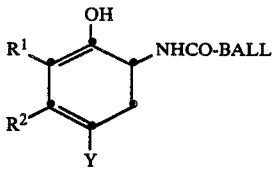

(IV)

wherein

BALL is a ballast group, $R^1$ is halogen, $R^2$ is hydrogen, lower alkyl or lower alkoxy, and Y is hydrogen or a coupling-off group; and a latex polymer which is free of repeating units containing coupler moieties, the polymer consisting essentially of recurring unit derived from a monomer represented by formula (I), below, and up to 20% by weight of an ionomer represented by formula (II), below:

$$CH_2{=}CH{-}\overset{O}{\overset{\|}{C}}{-}[O{-}(CH_2)_m]_n{-}OCH_3 \quad (I)$$

wherein m=1 to 4, and n=1 to 10;

$$CH_2{=}CH{-}\overset{O}{\overset{\|}{C}}{-}[O{-}(CH_2)_m]_{n'}{-}X \quad (II)$$

wherein m=1 to 4, n'=0 to 10,

X, when n'=0, represents —OH, and

X, when n'=1 to 10, represents $-CO_2H$, $-SO_3H$, $-O-PO(OH)_2$ or a metal salt of $-CO_2H$, $-SO_3H$ or $-O-PO(OH)_2$.

4. A photographic element according to any one of claims 1, 2 or 3, wherein the latex polymer is present in the photographic element in a concentration of from about 0.05 g to about 2 g per square meter.

5. A photographic element of claim 4, comprising a blue-sensitive yellow dye image forming layer unit, a green-sensitive, magenta dye image forming layer unit, and a red-sensitive, cyan dye image forming layer unit, wherein the polymer is present in the cyan dye forming layer unit.

6. In a process of bleaching silver from a photographic element having associated therewith image dye derived from a cyan dye forming coupler, the improvement comprising bleaching in the presence of a latex polymer which is free of repeating units containing coupler moieties, the polymer comprising recurring units derived from a monomer represented by formula (I), and up to 20% by weight of an ionomer represented by formula (II), below:

$$CH_2{=}CH{-}\overset{O}{\overset{\|}{C}}{-}[O{-}(CH_2)_m]_n{-}OCH_3 \quad (I)$$

wherein m=1 to 4, and n=1 to 10;

$$CH_2{=}CH{-}\overset{O}{\overset{\|}{C}}{-}[O{-}(CH_2)_m]_{n'}{-}X \quad (II)$$

wherein m=1 to 4, n'=0 to 10,

X, when n'=0, represents —OH, and

X, when n'=1 to 10, represents $-CO_2H$, $-SO_3H$, $-O-PO(OH)_2$ or a metal salt of $-CO_2H$, $-SO_3H$, $-O-PO(OH)_2$.

7. In a process of bleaching silver from a photographic element having associated therewith image dye derived from a cyan dye forming coupler, the improvement comprising said element containing a latex polymer which is free of repeating units containing coupler moieties, the polymer consisting essentially of recurring units derived from a monomer represented by formula (I), below, and up to 20% by weight of an ionomer represented by formula (II), below:

$$CH_2{=}CH{-}\overset{O}{\overset{\|}{C}}{-}[O{-}(CH_2)_m]_n{-}OCH_3 \quad (I)$$

wherein m=1 to 4, and n=1 to 10;

$$CH_2{=}CH{-}\overset{O}{\overset{\|}{C}}{-}[O{-}(CH_2)_m]_{n'}{-}X \quad (II)$$

wherein m=1 to 4, n'=0 to 10,

X, when n'=0, represents —OH, and

X, when n'=1 to 10, represents $-CO_2H$, $-SO_3H$, $-O-PO(OH)_2$ or a metal salt of $-CO_2H$, $-SO_3H$ or $-O-PO(OH)_2$.

8. A process of any one of claims 6 or 7, wherein bleaching is performed with a ferric complex of a polycarboxylic acid.

* * * * *

UNITED STATES PATENT AND TRADEMARK OFFICE

CERTIFICATE OF CORRECTION

PATENT NO. : 4,914,005

DATED : April 3, 1990

INVENTOR(S) : Philip T. S. Lau et al.

It is certified that error appears in the above-identified patent and that said Letters Patent is hereby corrected as shown below:

On the title page:

Under "References Cited", "4,374,722" should be --4,374,922--.

Column 9, line 24, "unit" should be --units--.

Signed and Sealed this

Fourteenth Day of May, 1991

*Attest:*

HARRY F. MANBECK, JR.

*Attesting Officer*

*Commissioner of Patents and Trademarks*